US005274860A

United States Patent [19]

Avila

[11] Patent Number: 5,274,860

[45] Date of Patent: Jan. 4, 1994

[54] WATER CONSERVING SHOWER ASSEMBLY

[76] Inventor: Henry G. Avila, 12358 San Fernando Rd., Sylmar, Calif. 91342

[21] Appl. No.: 840,394

[22] Filed: Feb. 24, 1992

[51] Int. Cl.[5] ..... A47K 3/22

[52] U.S. Cl. ..... 4/615; 4/605

[58] Field of Search ..... 4/567, 568, 596, 601, 4/605, 615

[56] References Cited

U.S. PATENT DOCUMENTS

| | | | |
|---|---|---|---|
| 1,840,812 | 1/1932 | Hardy | 4/615 X |
| 3,231,200 | 1/1966 | Heald | 4/596 X |
| 3,461,870 | 8/1969 | Van Linge | 128/229 |
| 3,742,521 | 7/1973 | Bolgert et al. | 4/541.4 |
| 3,971,074 | 7/1976 | Yxfeldt | 4/601 X |
| 4,274,400 | 6/1981 | Baus | 4/615 X |
| 4,311,279 | 1/1982 | Jette | 239/562 |
| 4,398,668 | 8/1983 | Jette | 239/414 |
| 4,554,690 | 11/1985 | Knapp et al. | 4/567 X |
| 4,793,331 | 12/1988 | Stewart | 4/615 X |
| 4,901,927 | 2/1990 | Valdivia | 4/615 X |
| 4,933,080 | 6/1990 | Rundzaitis et al. | 4/615 X |
| 4,964,181 | 10/1990 | Alpert | 4/601 X |
| 5,035,010 | 7/1991 | Sakamoto et al. | 4/567 |

FOREIGN PATENT DOCUMENTS

| | | | |
|---|---|---|---|
| 2854123 | 6/1980 | Fed. Rep. of Germany | 4/596 |
| 9117810 | 11/1991 | PCT Int'l Appl. | 4/605 |

*Primary Examiner*—William A. Cuchlinski, Jr.
*Assistant Examiner*—John L. Beres
*Attorney, Agent, or Firm*—Robert Louis Finkel

[57] ABSTRACT

A water conserving shower assembly utilizes a novel distributor connected to a domestic water line carrying hot and cold water combined in a predetermined ratio. A piping system carries water from the distributor and terminates in a shower head. The piping system is provided with a valve assembly which incorporates an on-off valve for interrupting the flow of water to the shower head, a flow metering device operated solely by means of a unique key, and a dump valve for bypassing the on-off valve and diverting water from the shower head while the shower temperature is coming to equilibrium at the temperature established by the hot-cold water ratio. A container captures the diverted water for later use.

9 Claims, 2 Drawing Sheets

FIG. 1
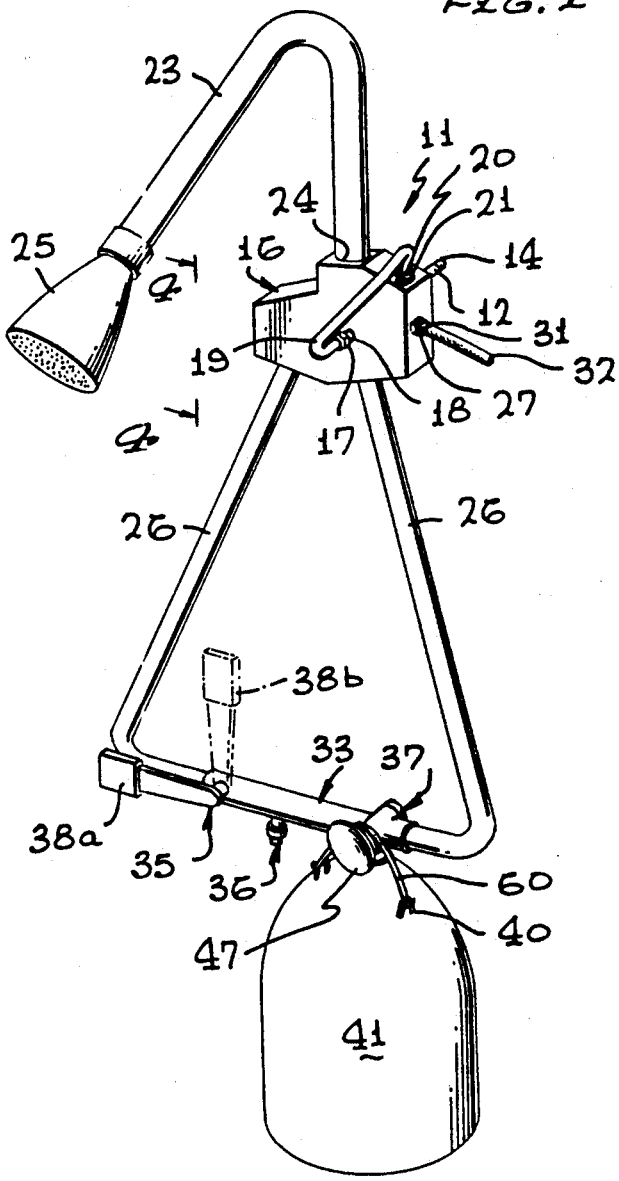
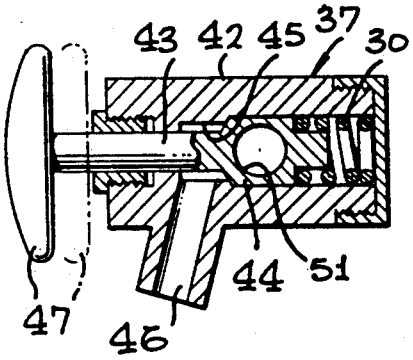
FIG. 3
FIG. 2
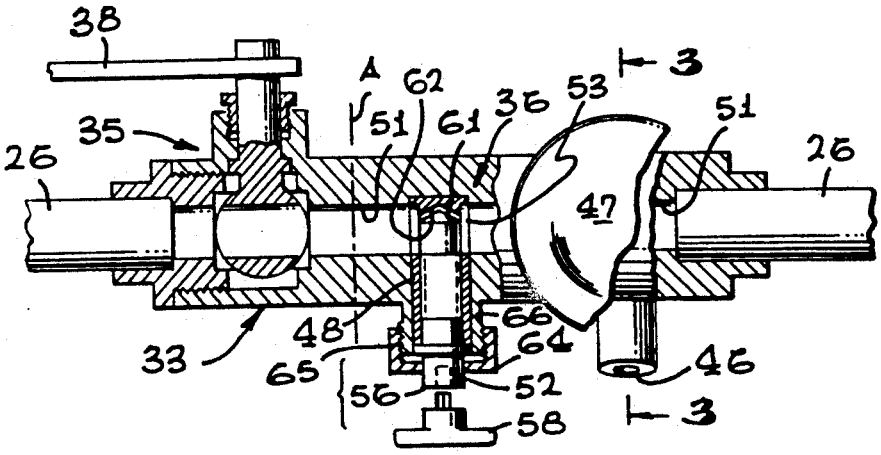

WATER CONSERVING SHOWER ASSEMBLY

BACKGROUND OF THE INVENTION

The present invention relates to the field of plumbing, and more particularly to shower assemblies intended primarily for domestic use.

Water conservation, long a matter of interest in other parts of the world, has become a topic of considerable concern on the North American Continent, and especially in the arid parts of the United States. Residents of several states have recently been asked to conserve by reducing the amount of water they use in their homes and businesses. In some areas which are particularly hard-hit by a chronic lack of precipitation, water has been rationed. Some experts forecast that water conservation will be a fact of life in dry regions of the country for the foreseeable future.

In response to the demand for water conservation, a number of devices for reducing domestic water usage by cutting down the amount of water used during a shower have reached the market. Some of these take the form of flow restrictors adapted for insertion into the water lines or shower valves. Others provide flow-limiting shower heads of various designs intended to take the place of existing inefficient, wasteful spray heads.

Neither type of device has found widespread acceptance for either commercial or private residential applications. There are two principal reasons: One is that most of the prior art inserts and replacement shower heads can easily be removed by impatient users who are more interested in getting a quick shower than in conserving water. This is a particular problem in the hotel and rental property industries because the ultimate user is generally not the person primarily responsible for regulating the water usage.

The second reason the currently available flow-regulating devices are unsatisfactory is that they do nothing to prevent the waste that occurs when the shower is turned on and while the water is coming to the desired temperature. This is a significant factor from the standpoint of the individual homeowner as well as the manager of multiple commercial units.

An object of my invention is to provide a temperature controlled water conserving shower assembly which can be readily and securely installed in place of an existing shower head.

Another object is to provide such a shower assembly in which the flow of water can be reliably adjusted with a tamper-proof mechanism to restrict the flow rate and control the delivery of water at a predetermined temperature.

Still another object is to provide an assembly of the type described in which the waste of water during the initial temperature adjustment period is minimized.

In satisfying these objects, my invention represents a unique improvement in the field of shower design and satisfies the long felt needs of the plumbing supplier, hotelier, landlord, and homeowner.

SUMMARY OF THE INVENTION

Conventionally, domestic showers include a valve or valves for adjusting the flow of cold water from the house line and hot water from the water heater passing through a common line to which a gooseneck and shower head are attached. The present invention is a water conserving shower assembly which is adapted to be attached to the shower line in place of the existing gooseneck and shower head.

The shower assembly includes a water distributor having a gooseneck extending from it. A shower head is swivably connected to the gooseneck. The distributor is connected to the shower line by a nipple or other conventional plumbing means, and communicates between the nipple and the gooseneck by means of appropriate tubing. The flow of water through this tubing is controlled by a novel unitary valve assembly.

The valve assembly comprises a shut-off valve, which may be of either the on-off or the variable flow type, a key-operated needle valve, which can only be adjusted by a person with a special key, and a dump valve. The shut-off valve controls the flow of water through the system. The needle valve limits the maximum rate of flow. The dump valve diverts the water in the assembly from the shower head to a container in which it can be stored for other uses.

With the shower assembly connected to the shower line and the shut-off valve in its open position, the "hot" and "cold" water valves are adjusted to establish a predetermined water temperature. Operation of the dump valve while the water is reaching equilibrium at the temperature predetermined by the setting of the valves virtually eliminates the waste of the relatively cold water which otherwise would have gone down the drain. Regardless of the type of shut-off valve employed, the needle valve restricts the maximum amount of water flowing through the shower assembly once the desired temperature is reached. Returning the shut-off valve to its normally closed position shuts off the flow of water through the shower assembly, but leaves the hot and cold valves adjusted in readiness for the user's next shower.

If desired, an attractive decorative cover may be provided having attachment means for mounting it to the shower assembly. The cover is designed to afford access for operation of the valve mechanism.

An appreciation of other aims and objectives of the present invention and a more complete understanding of its construction and operation may be achieved by referring to the accompanying drawings and to the following detailed description of the preferred embodiment of the invention illustrated in them.

BRIEF DESCRIPTION OF THE DRAWINGS

FIG. 1 is a frontal perspective view of a preferred embodiment of the temperature controlled water conserving shower assembly in accordance with my invention.

FIG. 2 is a fragmentary sectional view of the valve assembly as it is depicted in FIG. 1, but with the shut-off valve rotated in the reference plane "A" 90° clockwise (as viewed in the direction 3—3) to better show the details of its construction.

FIG. 3 is a fragmentary side sectional view of the dump-valve portion of the valve assembly of FIG. 2 taken along the line 3—3 showing the details of construction of the dump-valve, and the mounting arrangement for the waste water container.

DETAILED DESCRIPTION OF THE PREFERRED EMBODIMENT

Figure 6:
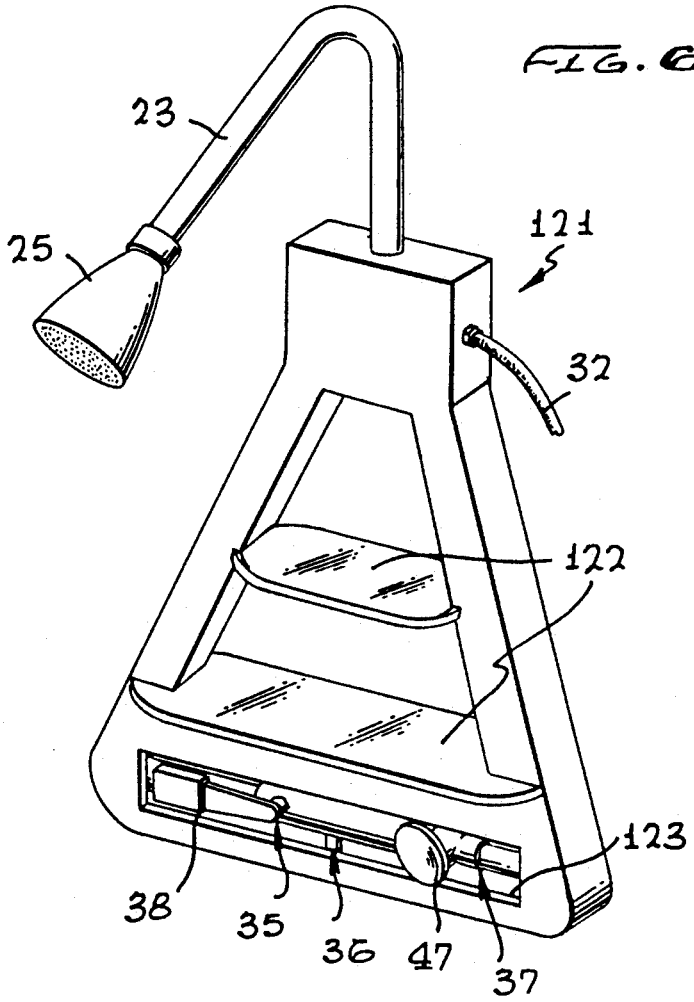
FIG. 6 is a front perspective view showing a decorative plate in accordance with the invention mounted to a shower assembly of the type illustrated in FIG. 1.

FIG. 1 shows a water conserving shower assembly 11 made in accordance with my invention. In this embodiment, a nipple 12 is provided which has external pipe threads on one end 14. Preferably, the nipple 12 is made of brass. The threaded end 14 is adapted for attachment to the shower line elbow or other fitting in the wall (not shown) to which the shower gooseneck would normally be connected.

The flow of "hot" water from the water heater and of "cold" water from the house line to the common shower line is controlled by one of a variety of commonly available manually operated valves (not shown). Although these valves are indirectly connected to the shower assembly, their specific construction and operation are not germane here, and they form no part of the invention.

The nipple 12 extends snuggly through, and, preferably, supports, a brass distributor body 16. A connection nut 17 threaded to the external end 18 of nipple 12 connects nipple 12 to the lower end of an intake tube 19, preferably of copper. The upper end of tube 19, in turn, is connected to the distributor body 16 by means of a second connection nut 20 on a second nipple 21 which is threaded into a port 22 formed in the top of the distributor body 16.

A gooseneck 23 is threaded into a second port 24 formed in the top of the distributor body 16. A standard, swivelable shower head 25 is connected to the gooseneck's lower end. The ends of a loop of tubing 26, preferably of copper, are connected by conventional means, such as soldering, to third and fourth ports 28, 29 formed in the distributor body 16. As will be explained in greater detail shortly, the ports in the distributor body 16 are connected internally of the body 16, whereby the water entering the shower assembly is routed through distributor 16 and loop 26, back through distributor 16 to gooseneck 23, and thence to showerhead 24.

Optionally, as shown in FIG. 1, an additional port 27 may be provided in distributor 16 to receive the threaded fitting 31 at the end of the flexible hose 32 of a standard hand-held shower assembly having a separate, manually operated shut-off valve (not shown).

The loop 26 contains a unitary valve assembly 33 for controlling the flow of water through the system. The valve assembly 33 includes three principal components: a shut-off valve 35, a needle valve 36, and a dump-valve 37.

Referring to FIGS. 2 and 3, the shut off valve 35, in this instance a conventional two-position ball valve, is activated by convenient means, such as a knob or handle 38. For illustrative purposes, typically when the handle 38 is in a first position, e.g., oriented approximately parallel to the body of valve 35 as designated by numeral 38*a*, the valve 35 is open. When the handle 38 is in a second position, e.g., oriented approximately perpendicular to the valve body, as designated by the numeral 38*b*, the valve 35 is closed. Only a quarter turn is necessary to rotate the valve 38 from full on to full off.

FIG. 2 shows a cross section of key operated needle valve 36. Such valves are typically made of brass. The needle valve 36 has an essentially cylindrical tubular body 48 disposed across the valve channel 51. Openings 53 in the wall of body 48 allow water to flow through the body 48. A stem 52 passes partially through the bore of body 48. One end 56 of stem 52 is adapted to be turned by a key 58. The other end 61 has a conical shape and conforms with the end of the bore 62. The stem 52 is retained in the body 48 by means of a bonnet 64 threaded over external threads 65 provided on a boss 66 formed on the valve body 48. The position of the conical end 61 within the body 48, and thus the flow rate of the water, is adjusted by turning the stem 62 clockwise or counterclockwise with the valve key 58.

FIGS. 2 and 3 describe the details of construction and operation of the dump-valve component 37 of valve assembly 33. In the embodiment illustrated, as in the case of shut-off valve 35 and needle valve 36, the generally cylindrical dump-valve housing 42 is formed integrally with and transverse to the valve assembly 33 housing. A stem 43 is adapted for reciprocation in the bore 45 of housing 42. The enlarged end 44 of stem 43 is normally positioned by spring 30 to form a barrier in bore 45 between the channel 51 in valve assembly 33 and drain 46 formed in housing 42. The opposite end of stem 43 extends outwardly of housing 42. A knob 45 enables the shower user to comfortably overcome the resistence of spring 30 and thereby displace the large end 44 of stem 43 sufficiently to expose channel 51 and discharge the water flowing in channel 51 through drain 46. As long as knob 45 remains depressed, all of the water will flow out the drain 46 and none will reach shower 25. Optionally, but highly advantageously, attachment means, such as permanent eyelets 40 and supporting straps 60 with hooked ends, are provided for mounting a sturdy, lightweight container, for example a one gallon plastic bottle 41, to housing 42 below drain 46. With such a container in place, water waste is reduced to a minimum, since the water captured in bottle 41 can be retained indefinitely for use at a later date.

Figure 4:
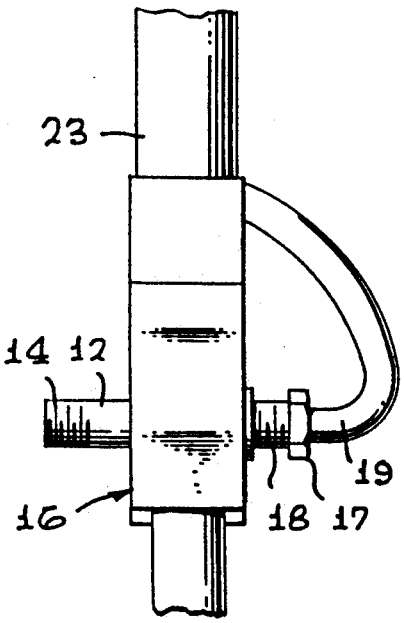
FIG. 4 is a fragmentary side elevational view of the distributor of FIG. 1 as seen looking in the direction 4—4 with portions cut away to show the arrangement of the nipple and tube sub-assembly used to connect the distributor to the shower line.

Turning briefly to FIG. 4, the nipple 12 is seen extending snuggly through the channel 83 in distributor body 16. The lower end of intake tube assembly 19 is connected to the external end 18 of nipple 12 by means of connector nut 17 threaded onto the end 18. The upper end of tube assembly 19 is connected to the nipple 21 threaded into port 22 by means of connector nut 20.

Figure 5:
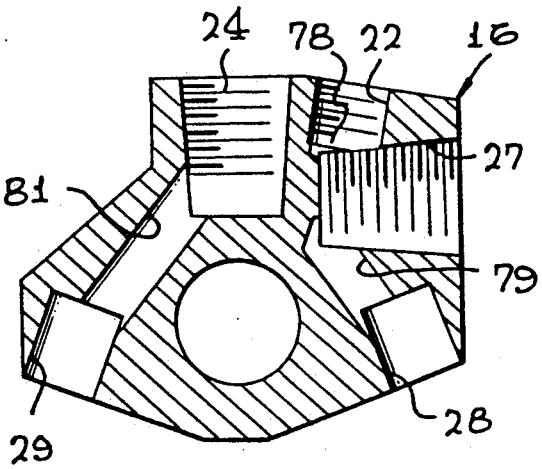
FIG. 5 is a frontal sectional view of the body of the distributor as it is seen in FIG. 1.

FIG. 5 affords a cross sectional view through the body of distributor 16. The solid body 16 is provided with a plurality of outwardly exposed ports 22, 27, 28, 29 and 24, and internal channels 78, 79 and 81 connecting them. A cylindrical channel 83 extending transversely through the distributor body 16 provides for snug passage of assembly mounting nipple 12.

The nipple 21 to which the upper end of intake tube 19 is connected is threaded into port 22. The fitting 31 on flexible hose 32 of the optional hand-held shower assembly is threaded into port 27. The ends of tube 26 are soldered into ports 28 and 29. And the gooseneck 22 screws into port 24. Internal channel 78 connects port 22 with port 27, and channel 79 connects port 27 with port 28. Internal channel 81, likewise, Connects port 24 with port 29. By means of this arrangement, water flows from the shower line through the shower assembly to the shower head under the control of valve assembly 33.

FIG. 6 illustrates a typical decorative trim 121 fastened by clamps (not shown) or other commonly available means to the assembly 11. In accordance with the subject invention, the trim 121 can be made of any suitable durable, water resistent material, such as ceramic, stainless steel, fiberglass, plastic, or the like, and can take any configuration desired for aesthetic or functional purposes. In the preferred embodiment shown, the trim 121 is a rigid, molded, glazed, ceramic cover plate having an ornamentally appealing shape and formed with shelves 122 for soap, shampoo, and other shower accessories. An opening 123 is provided in the face of the trim to afford access to the valve controls 38, 47, and 56.

The water conserving shower assembly 11 can be easily and securely mounted in shower stalls in new construction in lieu of a conventional gooseneck and shower head. It can also replace these items in existing shower stalls. In either case, the intake tube 19 is detached from the nipple 12 to allow the latter to be rotated freely. The nipple 12 is screwed into the existing fitting in the wall and the intake tube 19 and nipple 12 are reconnected. If necessary, or desired, the loop of tubing 26 can be fastened to the wall with conventional pipe clamps or other suitable means. After installation, the decorative trim is fastened to the assembly. The previously existing hot and cold or mixing valves, whichever are provided with the shower stall, are not affected by the installation.

After installation of the water conserving shower assembly 10, water flow rate may be regulated by adjusting the needle valve 36 with the special key 58. If the key 58 is removed to a secure location, the water flow rate adjustment cannot be tampered with by the user. This feature will be a boon to hoteliers and landlords. Additionally, once the water temperature is selected by adjustment of the existing valve system, the valves may be left at the desired setting and the water turned on and off using only the shut-off valve 35. This feature will reduce the time that the user spends adjusting water temperature and thus will minimize the time needed to complete a shower. More significantly, by utilizing the dump-valve to shunt cool line water to a handy container while the temperature is stabilizing, a major source of waste can be eliminated entirely. Since the shut off valve handle 38 is positioned at a low level, even small children and handicapped adults can invoke the benefits of my invention.

The advantages conferred by this invention are manifold. Among others, it provides means by which a preset temperature and flow rate can readily be established and, once established, reproduced faithfully by the turn of a single handle. It minimizes the time needed for the shower to reach the predetermined temperature, and affords easily operated means for capturing the water which would otherwise have been wasted while achieving that temperature. The invention makes it difficult for unauthorized persons to tamper with the predetermined water flow rate setting. The device is easy for a plumber or handy homemaker or maintenance person to install without demolishing walls. However, it is harder for unauthorized persons to remove or damage than conventional water restricting line inserts and shower heads. It provides a conveniently located shut off valve, a specially designed distributor body which serves to anchor and support the assembly securely in place as well as to provide a ready connection to the existing shower service.

The temperature controlled water conserving shower assembly 11 has been described with reference to a particular embodiment. However, various modifications can easily be made. For example, the various components can be made of any suitable alternative materials. In like manner, all of the connections called for can be made by alternative methods and means. It will be appreciated, also, that the physical layout and external configuratiion of the assembly and the trim can be changed without affecting their function. It will be obvious to those skilled in the art to which this invention pertains that other modifications and enhancements can be made, as well, without departing from the spirit and scope of the claims that follow.

What is claimed is:

1. A water conserving shower assembly, comprising:
- a distributor adapted for connection to a domestic water line carrying hot and cold water in a predetermined ratio;
- a piping system carrying water from said distributor and terminating in a shower head; and
- a valve assembly means in said piping system for independently regulating, interrupting and diverting the flow of water passing from said distributor to said shower head.

2. A water conserving shower assembly in accordance with claim 1, wherein said valve assembly includes flow metering means.

3. A water conserving shower assembly in accordance with claim 2, wherein said flow metering means is a needle valve.

4. A water conserving shower assembly in accordance with claim 3, wherein said valve assembly includes on-off valve means.

5. A water conserving shower assembly, comprising:
- a distributor adapted for connection to a domestic water line carrying hot and cold water in a predetermined ratio;
- a piping system carrying water from said distributor and terminating in a shower head;
- a valve assembly in said piping system, said valve assembly including independently operable:
  - on-off valve means for interrupting the flow of water from said distributor to said shower head;
  - flow metering means for regulating the rate of flow of water to the shower head; and
  - dump valve means for diverting water from said shower head.

6. A water conserving shower assembly in accordance with claim 5, wherein said flow metering means is operated by means of a removable unique key.

7. A water conserving shower assembly in accordance with claim 5, wherein said dump valve means is in series with and upstream of said flow metering means.

8. A water conserving shower assembly in accordance with claim 5, wherein said flow metering means is a needle valve.

9. A water conserving shower assembly in accordance with claim 5, comprising a container associated with said dump valve means for receiving water from said dump valve means, whereby water diverted from said shower head is retained for future use.

* * * * *